US008147624B2

(12) United States Patent
Jha et al.

(10) Patent No.: US 8,147,624 B2
(45) Date of Patent: Apr. 3, 2012

(54) ELECTRODE

(75) Inventors: Animesh Jha, Leeds (GB); Xiaobing Yang, Leeds (GB)

(73) Assignee: University of Leeds, Leeds (GB)

( * ) Notice: Subject to any disclaimer, the term of this patent is extended or adjusted under 35 U.S.C. 154(b) by 683 days.

(21) Appl. No.: 11/922,806

(22) PCT Filed: Jun. 13, 2006

(86) PCT No.: PCT/GB2006/002147

§ 371 (c)(1),
(2), (4) Date: Jan. 21, 2009

(87) PCT Pub. No.: WO2006/136785

PCT Pub. Date: Dec. 28, 2006

(65) Prior Publication Data

US 2009/0166217 A1 Jul. 2, 2009

(30) Foreign Application Priority Data

Jun. 21, 2005 (GB) ..... 0512836.8
Jan. 12, 2006 (GB) ..... 0600575.5

(51) Int. Cl.
*C22C 21/12* (2006.01)
*C22C 9/01* (2006.01)

(52) U.S. Cl. ..... 148/438; 148/437; 148/439; 148/429; 148/432; 148/435; 148/436; 148/549; 148/553; 420/417; 420/418; 420/469; 420/489; 420/528; 420/529; 420/535; 420/538

(58) Field of Classification Search ..... 204/293; 420/417, 418, 469, 489, 528, 529, 535, 538; 148/438, 437, 439, 429, 432, 549, 553
See application file for complete search history.

(56) References Cited

U.S. PATENT DOCUMENTS

| | | | | |
|---|---|---|---|---|
| 5,032,196 | A * | 7/1991 | Masumoto et al. | 148/403 |
| 5,240,517 | A | 8/1993 | Matsumoto et al. | |
| 5,320,688 | A | 6/1994 | Masumoto et al. | |
| 5,368,658 | A | 11/1994 | Masumoto et al. | |
| 5,792,288 | A * | 8/1998 | Masih et al. | 148/421 |
| 6,083,362 | A | 7/2000 | Hryn et al. | |

FOREIGN PATENT DOCUMENTS

| | | |
|---|---|---|
| DE | 198 12 144 A1 | 9/1999 |
| FR | 650.982 | 2/1929 |
| JP | 4341529 | 11/1992 |
| JP | 6093393 | 4/1994 |
| JP | 6093394 | 4/1994 |

OTHER PUBLICATIONS

South Wales Patent Office Seach Report, (May 2006).

Z. Lee, et a., Microstructural Evolution of Cryomilled Nanocrystalline AI-Ti-Cu Alloy, Ultrafine Grained Materials Proceedings, TMS Annual Meeting Feb. 17, 2002, pp. 653-659.

Zhongning Shi, et al., Copper-Nickel Superalloys as Intert Alloy Anodes for Aluminum Electrolysis, JOM vol. 55, No. 11, Nov. 1, 2003, pp. 63-65.

* cited by examiner

*Primary Examiner* — Bruce Bell
(74) *Attorney, Agent, or Firm* — Wells St. John P.S.

(57) ABSTRACT

The present invention relates to an electrode composed of an Al-M-Cu based alloy, to a process for preparing the Al-M-Cu based alloy, to an electrolytic cell comprising the electrode the use of an Al-M-Cu based alloy as an anode and to a method for extracting a reactive metal from a reactive metal-containing source using an Al-M-Cu based alloy as an anode.

7 Claims, 13 Drawing Sheets

ELECTRODE

RELATED PATENT DATA

This application is a 35 U.S.C. §371 of and claims priority to PCT International Application Number PCT/GB2006/002147, which was filed 13 Jun. 2006 (13.06.2006) and which was published in English, which claims priority to both GB Application No. 0512836.8 filed 21 June, 2005 (21.06.2005) and GB Patent Application No. 0600575.5 filed 12 January, 2006 (12.01.2006) the entirety of all of which are incorporated herein by reference.

The present invention relates to an electrode composed of an Al-M-Cu based alloy, to a process for preparing the Al-M-Cu based alloy, to an electrolytic cell comprising the electrode, to the use of an Al-M-Cu based alloy as an anode and to a method for extracting a reactive metal from a reactive metal-containing source using an Al-M-Cu based alloy as an anode.

Aluminium metal is produced via the electrochemical dissociation of alumina dissolved in a fluoride melt consisting of $AlF_3$ and NaF known as cryolite ($3NaF.AlF_3$). The cell reaction involves several steps (see F Habashi: *A Handbook of Extraction Metallurgy*, vol. 3, VCH, Berlin) and relies on the use of carbon anodes and cathodes. To illustrate the need for a consumable carbon anode, a simplified description of the cell reaction is.

$$\frac{1}{2}Al_2O_3\{\text{dissolved}) + \frac{3}{4}C(s) = Al(l) + \frac{3}{4}CO_2$$

The combustion of carbon is necessary to maintain the temperature of the molten aluminium and cryolite bath which moderates the electrical energy consumption of the cell. In the cell, the power consumption for making aluminium is of the order of 6.3 kWh/kg which is equivalent to 2.1 V and represents 50% of the total energy consumption of the cell. The remaining 50% (or 2.1V) of the total energy consumption maintains the cell temperature in the face of heat losses (and is equivalent to 6.3 kWh/kg for making aluminium metal). For each tonne of aluminium metal produced, 333 kg of carbon is oxidised at the anode to carbon dioxide gas which escapes into the atmosphere. The evolution of carbon dioxide is one of the main sources of greenhouse gas emission in the aluminium industry.

Periodically (eg monthly) the carbon electrode is replaced with a new one. During this change over period, the electrolyte in the bath becomes under saturated and reacts with carbon to produce small concentrations of perfluorocarbon (PFC) gases. Moreover the presence of fluoride salt melt in the Al-electrolytic cell and the large current surge during cell operation lead to decomposition of fluoride salts into reactive forms of fluorine gas which readily react with carbon present in the electrodes to generate PFCs. PFCs also form during anode effect. When the PFCs escape into the atmosphere, they contribute to ozone depletion. PFCs also pose a major health risk to plant workers.

The manufacture of carbon electrodes uses petroleum products which decompose and release hydrocarbon based greenhouse gases. The processing and manufacturing route for electrodes is quite complex and time-consuming. In the lengthy process, the material is prebaked and fired for graphitization at 3000° C. for 1 month. A large volume of greenhouse gases (eg methane, sulphur and sulphur dioxide) is emitted during anode fabrication. The costs of energy consumption for a carbon anode is as large as the production metal. Coal tar pitch is used in making Soderberg anodes and during this process $SO_2$ forms and contributes to environmental pollution. 11.5 mT of coke for making carbon anodes is consumed globally.

Global aluminium companies have targets to reduce the emission of greenhouse gases and ozone-depleting PFCs. In North America, the major aluminium metal producers have agreed to consider replacing carbon-based electrodes with new non-consumable/inert electrodes.

Most inert electrodes developed to date are based on ceramic powder and cermet-based technologies. ALCOA has successfully demonstrated the use of $NiO.Fe_2O_3$-based cermets with a noble metal such as silver and copper for enhancing the electronic conductivity of the cermet electrodes (see U.S. Pat. No. 5,865,980). Since the cermets are made via the ceramic powder fabrication technique, there is apparently a cost implication compared to molten metal melting and casting techniques. Although nickel ferrites have both ionic and electronic conductivities, the major enhancement in the electronic conductivity arises from the presence of the noble metallic phases dispersed in the nickel-ferrite matrix. However the fabrication of ferrite anodes is via ceramic processing and requires firing and sintering above 1100° C. for several days.

For many years, titanium diboride powders have been used for making ceramic electrodes for producing molten aluminium (see U.S. Pat. No. 4,929,328). The diborides exhibit high-temperature electrical resistivity of 14 μohm cm and thermal conductivity of 59 W $m^2$ $K^{-1}$. The sintered materials also exhibit high oxidation and corrosion resistance. $TiB_2$ has a high melting point and so there is an inherent cost for processing and sintering ceramic powders. Adding alumina in the matrix for reducing the processing and sintering temperatures compromises the conductivity of $TiB_2$ and its composites. The composite can also be fabricated by making a partially sintered material using the self-heating high-temperature synthesis (SHS) of $TiB_2$ and alumina. There has been also some research and development activity in processing copper-nickel, copper-nickel-iron and copper-based cermets for electrode materials (see U.S. Pat. No. 6,126,799, U.S. Pat. No. 6,030,518 and D R Sadoway: "*Inert Anodes for Hall-Héraoult cell—the ultimate materials challenge*", J Metals, vol. 53, May 2001, pp. 34-35). However there appears to be some reliability issues for such electrode materials at high-temperatures due to the high solubility of copper in liquid and solid aluminium which may reduce the structural performance of the copper-based cermets.

The present invention is based on the recognition that certain Al-M-Cu based alloys exhibit high-temperature strength, corrosion resistance and electrical conductivity without major resistive heat loss and so can be exploited as an inert electrode, in particular as an inert electrode to replace carbon anodes in a Hall-Héraoult cell for extraction of reactive metals such as Al, Ti, Nb, Ta, Cr and rare-earth metals.

Thus viewed from one aspect the present invention provides an electrode (eg an anode) composed of an Al-M-Cu based alloy comprising an intermetallic phase of formula:

$$Al_xM_yCu_z$$

wherein:

M denotes one or more metallic elements;

x is an integer in the range 1 to 5;

y is an integer being 1 or 2; and z is an integer being 1 or 2.

The electrical resistivity of embodiments of the electrode of the invention was found to decrease as a function of temperature and illustrates the usefulness of the ordered high-temperature alloy as an inert electrode. The desirable electronic conductivity arises due to the presence of metallic copper which has the added advantage that it is much cheaper than alternatives such as silver and gold. By way of example the electrode of the invention performs well as an anode an alumina-saturated cryolite bath at 850° C.

The Al-M-Cu based alloy may be substantially monophasic or multiphasic. Preferably the intermetallic phase is present in the Al-M-Cu based alloy in an amount of 50 wt % or more (eg in the range 50 to 99 wt %). Preferably the Al-M-Cu based alloy further comprises an ordered high-temperature intermetallic phase of M with aluminium, particularly preferably $Al_3M$. Other intermetallic phases may be present.

In a preferred embodiment, the Al-M-Cu based alloy is substantially free of $CuAl_2$. This is advantageous because $CuAl_2$ has a tendency to melt at the elevated temperatures which are deployed typically in metal extraction (eg 750° C. for aluminium extraction). Preferably $CuAl_2$ is complexed.

In a preferred embodiment, the Al-M-Cu based alloy falls other than on the M poor side of the tie line joining $Al_3M$ and $MCu_4$ (eg on the M rich side of the tie line joining $Al_3M$ and $MCu_4$).

In a preferred embodiment, the Al-M-Cu based alloy comprises an intermetallic phase falling on or near to the tie line joining $Al_3M$ and $MCu_4$.

In a preferred embodiment, the Al-M-Cu based alloy falls other than on the M poor side of the tie line joining $Al_3M$ and $AlMCu_2$ (eg on the M rich side of the tie line joining $Al_3M$ and $AlMCu_2$).

In a preferred embodiment, the Al-M-Cu based alloy comprises an intermetallic phase falling on or near to the tie line joining $Al_3M$ and $AlMCu_2$.

In a preferred embodiment, the Al-M-Cu based alloy falls other than on the M poor side of the $\xi$, $Al_5M_2Cu$, $MAlCu_2$ and $\beta$-$MCu_4$ phase tie line (wherein $\xi$ is a phase falling between $Al_3Ti$ and $Al_2Ti$ with 3 at % or less of Cu (eg 2-3 at % Cu)).

In a preferred embodiment, the Al-M-Cu based alloy comprises an intermetallic phase falling on or near to the $\xi$, $Al_5M_2Cu$, $MAlCu_2$ and $\beta$-$MCu_4$ phase tie line.

Preferably the intermetallic phase is $Al_5M_2Cu$. Particularly preferably the Al-M-Cu based alloy further comprises $Al_3M$.

Preferably the intermetallic phase is $MAlCu_2$. Particularly preferably the Al-M-Cu based alloy further comprises $\beta$-$MCu_4$.

The electrode may be composed of a homogenous, partially homogenous or non-homogeneous Al-M-Cu based alloy.

In a preferred embodiment, the electrode comprises a passivating layer. Preferably the passivating layer withstands electrode oxidation in anodic conditions.

In a preferred embodiment, M is a single metallic element. The single metallic element is preferably Ti.

In an alternative preferred embodiment, M is a plurality (eg two, three, four, five, six or seven) of metallic elements. In this embodiment, a first metallic element is preferably Ti. Typically the first metallic element of the plurality of metallic elements is present in a substantially higher amount than the other metallic elements of the plurality of metallic elements. Each of the other metallic elements may be present in a trace amount. Each of the other metallic elements may be a dopant. Each of the other metallic elements may substitute Al, Cu or the first metallic element. The presence of the other metallic elements may improve the high-temperature stability of the alloy (eg from 1200° C. to 1400° C.).

In a preferred embodiment, M is a pair of metallic elements. In this embodiment, a first metallic element is preferably Ti. Typically the first metallic element of the pair of metallic elements is present in a substantially higher amount than a second metallic element of the pair of metallic elements (eg in a weight ratio of about 9:1). The second metallic element may be present in a trace amount. The second metallic element may be a dopant. The second metallic element may substitute Al, Cu or the first metallic element. The presence of a second metallic element may improve the high-temperature stability of the alloy (eg from 1200° C. to 1400° C.).

Preferably the pair of metallic elements have similar atomic radii. Preferably the atomic radius of the second metallic element is similar to the atomic radius of Cu. Preferably the atomic radius of the second metallic element is similar to the atomic radius of Al.

In a preferred embodiment, M is one or more of the group consisting of group B transition metal elements (eg first row group B transition metal elements) and lanthanide elements. Preferably M is one or more group IVB, VB, VIB, VIIB or VIIIB transition metal elements, particularly preferably one or more group IVB, VIIB or VIIIB transition metal elements.

In a preferred embodiment, M is one or more metallic elements of valency II, III, IV or V, preferably II, III or IV.

In a preferred embodiment, M is one or more metallic elements selected from the group consisting of Ti, Zr, Cr, Nb, V, Co, Ta, Fe, Ni, La and Mn. In a particularly preferred embodiment, M is one or more metallic elements selected from the group consisting of Ti, Fe, Cr and Ni.

Preferably M is or includes a metallic element capable of reducing the tendency of $CuAl_2$ towards grain boundary segregation at an elevated temperature. In this embodiment, the metallic element capable of reducing the tendency of $CuAl_2$ towards grain boundary segregation at an elevated temperature may be the second metallic element of a plurality (eg a pair) of metallic elements. Particularly preferably M is or includes a metallic element capable of forming a complex with $CuAl_2$. Preferred metallic elements for this purpose are selected from the group consisting of Fe, Ni and Cr, particularly preferably Ni and Fe, especially preferably Ni.

Preferably M is or includes a metallic element capable of reducing the tendency of the first metallic element or Cu to dissolve in molten extractant. In this embodiment, the metallic element may be the second metallic element of a plurality (eg a pair) of metallic elements. Preferred metallic elements for this purpose are selected from the group consisting of Fe, Ni, Co, Mn and Cr, particularly preferably the group consisting of Fe and Ni (optionally together with Cr).

Preferably M is or includes a metallic element capable of promoting the passivation of the surface of the electrode (eg anode) in the presence of a molten electrolyte. For this purpose, the metallic element may form or stabilise an oxide film. In this embodiment, the metallic element may be the second metallic element of a plurality (eg a pair) of metallic elements. Preferred metallic elements for this purpose are selected from the group consisting of Fe, Ni and Cr. Particularly preferably M is Ti, Fe, Ni and Cr in which the formation of a combination of oxides such as iron oxides, chromium oxides, nickel oxides and alumina advantageously promotes passivation.

Preferably M is or includes a metallic element selected from the group consisting of Zr, Nb and V. Particularly preferred is V or Nb. These second metallic elements are advantageously strong intermetallic formers. In this embodiment, the metallic element is the second metallic element of a plurality (eg a pair) of metallic elements.

Preferably M is or includes a metallic element capable of forming an ordered high-temperature intermetallic phase with aluminium metal. Particularly preferably M is or includes a metallic element capable of forming $Al_3M$.

Preferably M is or includes Ti. A titanium containing alloy typically has electrical resistivity in the range 3 to 15 μohm cm at room temperature.

Preferably the intermetallic phase is $Al_5Ti_2Cu$. Particularly preferably the Al—Ti—Cu based alloy further comprises $Al_3Ti$.

Preferably the intermetallic phase is $TiAlCu_2$. Particularly preferably the Al—Ti—Cu based alloy further comprises β-$TiCu_4$.

In a preferred embodiment, M is or includes Ti and a second metallic element selected from the group consisting of Fe, Cr, Ni, V, La, Nb and Zr, preferably the group consisting of Fe, Cr and Ni. The second metallic element advantageously serves to enhance high-temperature stability of the Al—Ti—Cu phases.

The electrode of the invention may be composed of an Al-M-Cu based alloy obtainable by processing a mixture of 35 atomic % Al or more (preferably 50 atomic % Al or more), 35 atomic % M or more (wherein M is a first metallic element as hereinbefore defined) and a balance of Cu and optionally M' (wherein M' is one or more additional metallic elements as hereinbefore defined).

In a preferred embodiment, the electrode of the invention is composed of an Al-M-Cu based alloy obtainable by processing a mixture of (65+x) atomic % Al, (20+y) atomic % M (wherein M is a first metallic element as hereinbefore defined) and (15−x−y) atomic % Cu, optionally together with z atomic % of M' (wherein M' is one or more additional metallic elements as hereinbefore defined) wherein M' substitutes Cu, Al or M.

In this embodiment, the alloy may be obtainable by casting, preferably in an oxygen deficient atmosphere (eg an inert atmosphere). For example, a mixture may be melted in an argon-arc furnace under an atmosphere of argon gas and then solidified in an argon atmosphere. Alternatively in this embodiment, the alloy may be obtainable by flux-assisted melting. The electrode may be processed in near-net shape eg a finished square-shape rod.

In a preferred embodiment, the electrode of the invention is at least as conducting at elevated temperature (eg at 900° C.) as a carbon electrode.

In a preferred embodiment, the electrode of the invention exhibits good thermal conductivity.

In a preferred embodiment, the electrode of the invention is electrochemically stable (eg is substantially non-soluble in the electrolyte). In a preferred embodiment, the electrode of the invention is resistant to oxidation and corrosion at high temperatures.

In a preferred embodiment, the electrode of the invention exhibits good high-temperature strength, thermal shock and thermal and electrical fatigue resistance.

In a preferred embodiment, the electrode of the invention is wettable by a molten metal-containing source from which it is desired to extract metal (eg aluminium) whereby to reduce cathode resistance.

The electrode will generally be non-toxic and non-carcinogenic (and not lead to the generation of toxic or carcinogenic materials). The electrode may be recyclable. The electrode may be safely disposable.

It is quite well known within the aluminium industry that the $Al_3Ti$ phase can be dispersed via the reactive melting of aluminium metal in the presence of $K_2TiF_6$. The reaction between molten aluminium and $K_2TiF_6$ yields a mixture of $Al_3Ti$ and aluminium metal. This technique has however been only used to make binary Al—Ti alloys with less than 1-2 wt % Ti for which the processing temperature is between 750° C. and 850° C.

Viewed from a further aspect the present invention provides a process for preparing an Al-M-Cu based alloy as hereinbefore defined comprising:

(a) adding an alkali fluorometallate flux to a source of Cu and a source of Al.

In accordance with the process of the invention, the presence of fluorine (eg in a fluorine bath) advantageously reduces hydrogen solubility in the Al-M-Cu liquid to yield a porosity-free cast structure which would otherwise have a higher resistive loss due to a high volume of pores.

The alkali fluorometallate may be a potassium or sodium alkali fluorometallate (eg fluorotitanate) salt.

The source of Cu and source of Al may be a molten Al—Cu alloy.

In a preferred embodiment, step (a) is carried out in an oxygen deficient atmosphere (eg an inert atmosphere such as argon or nitrogen).

In a preferred embodiment, the process further comprises:

(b) annealing the Al-M-Cu cast alloy from step (a).

Step (b) may be carried out in an oxygen deficient atmosphere (eg an inert atmosphere such as argon or nitrogen) at temperatures typically in the range 600-1000° C. (eg about 800° C.). Step (b) serves to eliminate deleterious phases such as $Al_2Cu$ and other low melting point inhomogeneities.

Step (b) may be preceded or succeeded by (c) the formation (eg coating) of an oxide layer on the Al-M-Cu surface. The oxide layer is preferably a mixed oxide layer containing alumina, iron oxide, nickel oxide and optionally chromium oxide. Step (c) may be carried out at an elevated temperature. The oxide layer may be formed from a slurry of mixed oxides which may be applied to the cast alloy before step (b) or be subjected to a separate heating step. By way of example, a preferred slurry is a 50:50 by volume water/ethyl alcohol comprising 35-45 mol % $Fe_2O_3$, 30-45 mol % NiO, 10-20 mol % alumina and 0-5 mol % $Cr_2O_3$.

Viewed from a yet further aspect the present invention provides a method for extracting a reactive metal from a reactive metal-containing source comprising:

electrolytically contacting an electrode composed of an Al-M-Cu based alloy with the reactive metal-containing source.

The electrode may be as hereinbefore defined for the first aspect of the invention. The reactive metal may be selected from the group consisting of Al, Ti, Nb, Ta, Cr and rare-earth metals (eg lanthanides or actinides). Preferred is Al.

Preferably the reactive metal-containing source is a molten bath, particularly preferably a molten bath containing reactive metal oxide. For the extraction of aluminium, the molten bath is alumina-containing, particularly preferably alumina-saturated, especially preferably is an alumina-saturated cryolite flux. Preferably the cryolite flux comprises sodium-containing potassium cryolite (eg sodium-containing $3KF.AlF_3$ such as $K_3AlF_6$—$Na_3AlF_6$). The weight ratio of NaF to $AlF_3$ in the sodium-containing potassium cryolite may be in the range to 1:1.5 to 1:2.

In a preferred embodiment, $KBF_4$ is present in the cryolite flux. The presence of $KBF_4$ dramatically improves the wettability of an electrode composed of an Al-M-Cu alloy.

Preferably alloy comprises a passivating layer which prevents oxidation under anodic conditions.

Viewed from a still yet further aspect the present invention provides the use of an Al-M-Cu based alloy as an anode in an electrolytic cell.

Preferably the Al-M-Cu based alloy in this aspect of the invention is as hereinbefore defined.

Viewed from an even still yet further aspect the present invention provides an electrolytic cell comprising an electrode as hereinbefore defined.

The present invention will now be described in a non-limitative sense with reference to Examples and the accompanying Figures in which:

FIG. 1*a* is a phase diagram of the Al—Ti—Cu alloy system (isothermal section at 540° C.);

FIG. 1*b* is a phase diagram of the Al—Ti—Cu alloy system (isothermal section at 800° C.);

FIG. 1*c* is a phase diagram of the Al—Ti—Cu alloy system showing various equilibrium points (not an isothermal section);

FIG. 2*a* illustrates the results of microstructure and energy dispersive X-ray analysis of the as-cast Alloy-1;

FIG. 2*b* illustrates the results of microstructure and energy dispersive X-ray analysis of heat treated Alloy-1;

FIG. 3*a* illustrates the results of microstructure and EDX analysis of as-cast Alloy-2;

FIG. 3*b* illustrates the results of microstructure and EDX analysis of heat treated Alloy-2;

FIG. 4 illustrates the effect of thermal cycling on the resistivities of Alloy-1 and Alloy-2;

FIG. 5*a* illustrates the results of DTA of Alloy 1 in the as-cast state and after a $1^{st}$ thermal cycle;

FIG. 5*b* illustrates the results of DTA of Alloy 2 in the as-cast and after a $1^{st}$ thermal cycle;

FIG. 6*a* is an illustration of a cell with a power supply;

FIG. 6*b* is a detailed illustration of the cell of FIG. 6*a;*

Figure 10A:
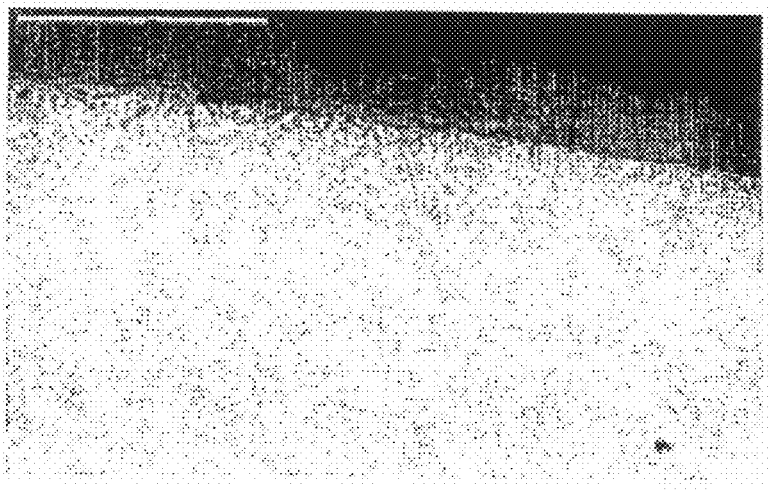
Figure 12A:
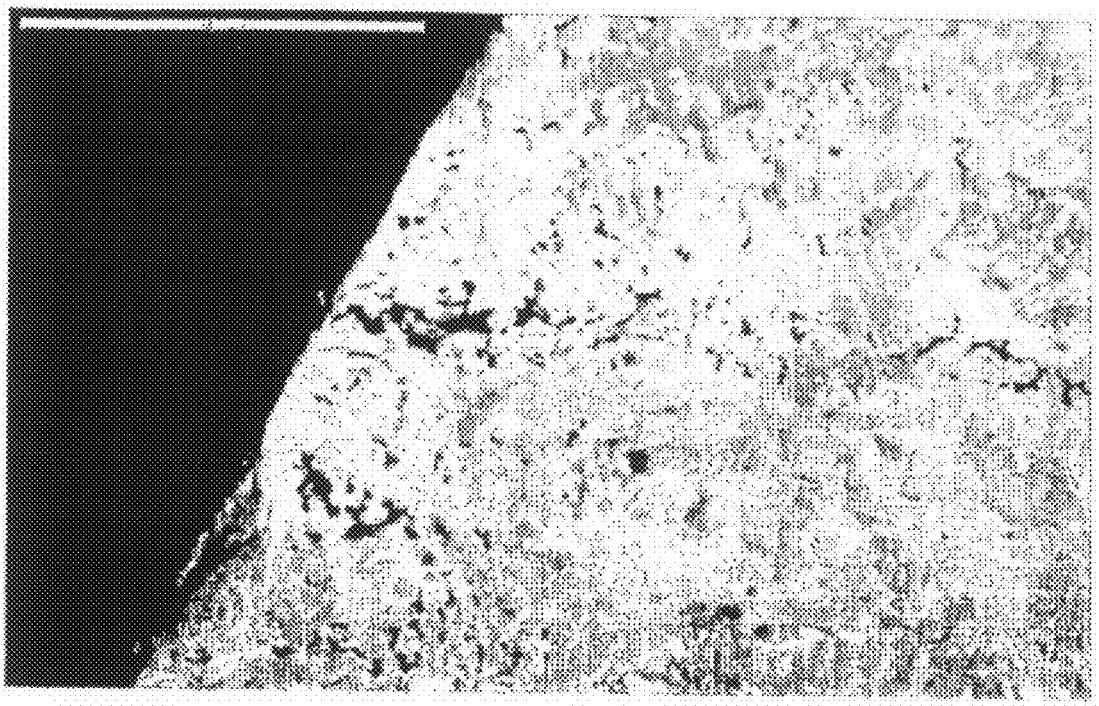
Figure 12B:
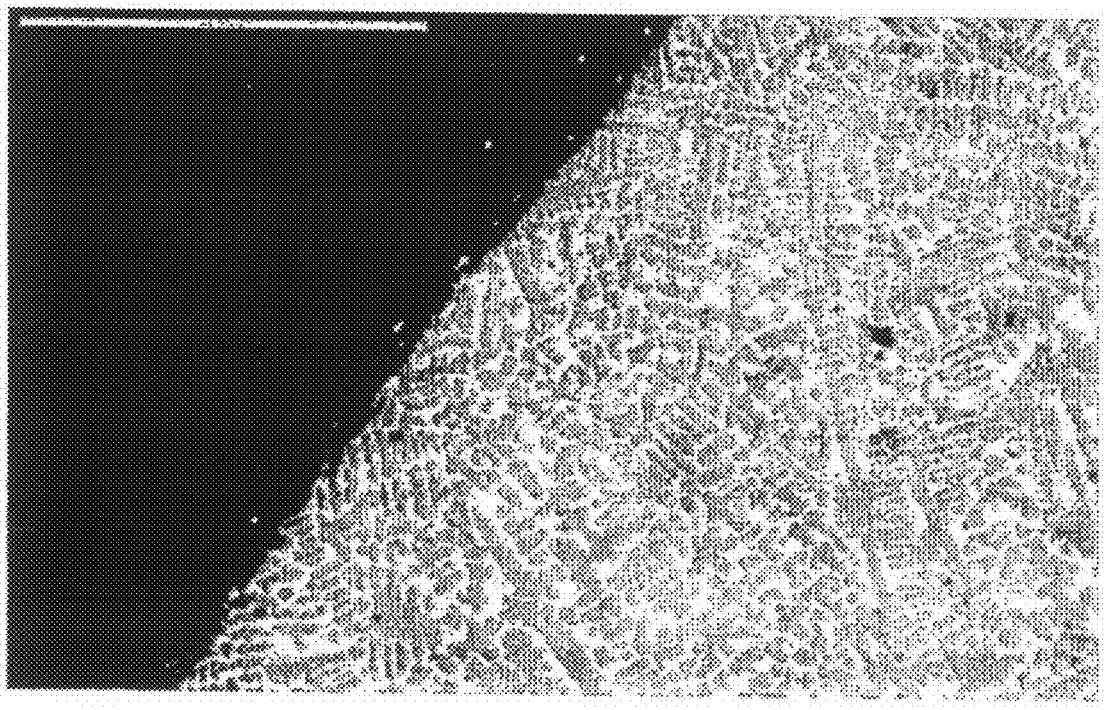

FIGS. 10*a* and *b* illustrate the microstructure of a S—NiFeCr alloy after a corrosion experiment in cryolite at 950° C. for 4 hours (The micrometer bar represents 200 μm in (a) and 50 μm in (b));

FIGS. 11*a-d* are a comparison of two alloys after a corrosion test in cryolite at 950° C. for 4 hours (The micrometer bar represents 200 μm in (a-b) and 100 μm in (c-d)); and FIG. 12 is a comparison of two alloys after a corrosion test in a $CaCl_2$ bath at 950° C. for 4 hours (The micrometer bar represents 100 μm).

EXAMPLE 1

Figure 1A:
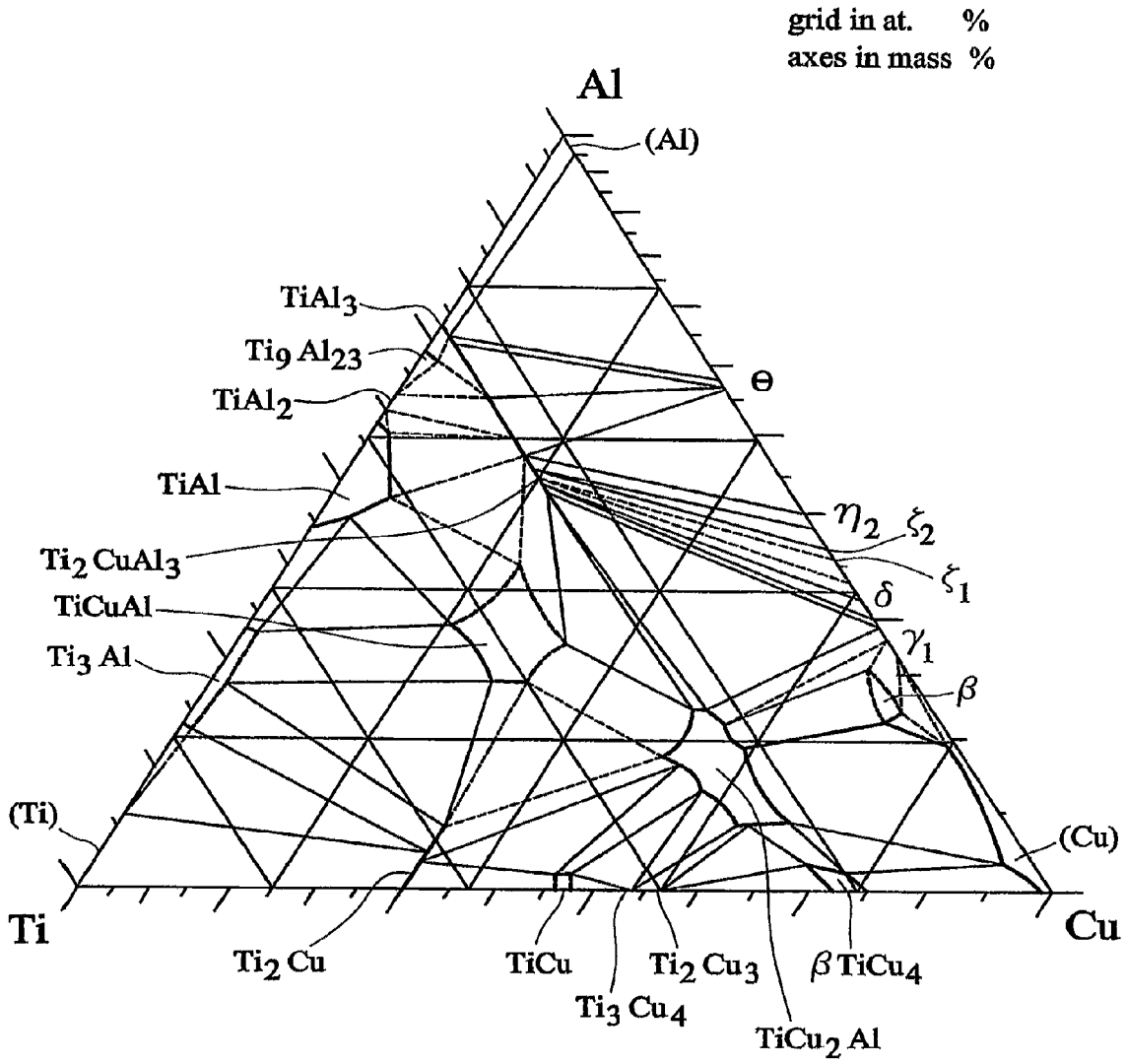
Figure 1B:
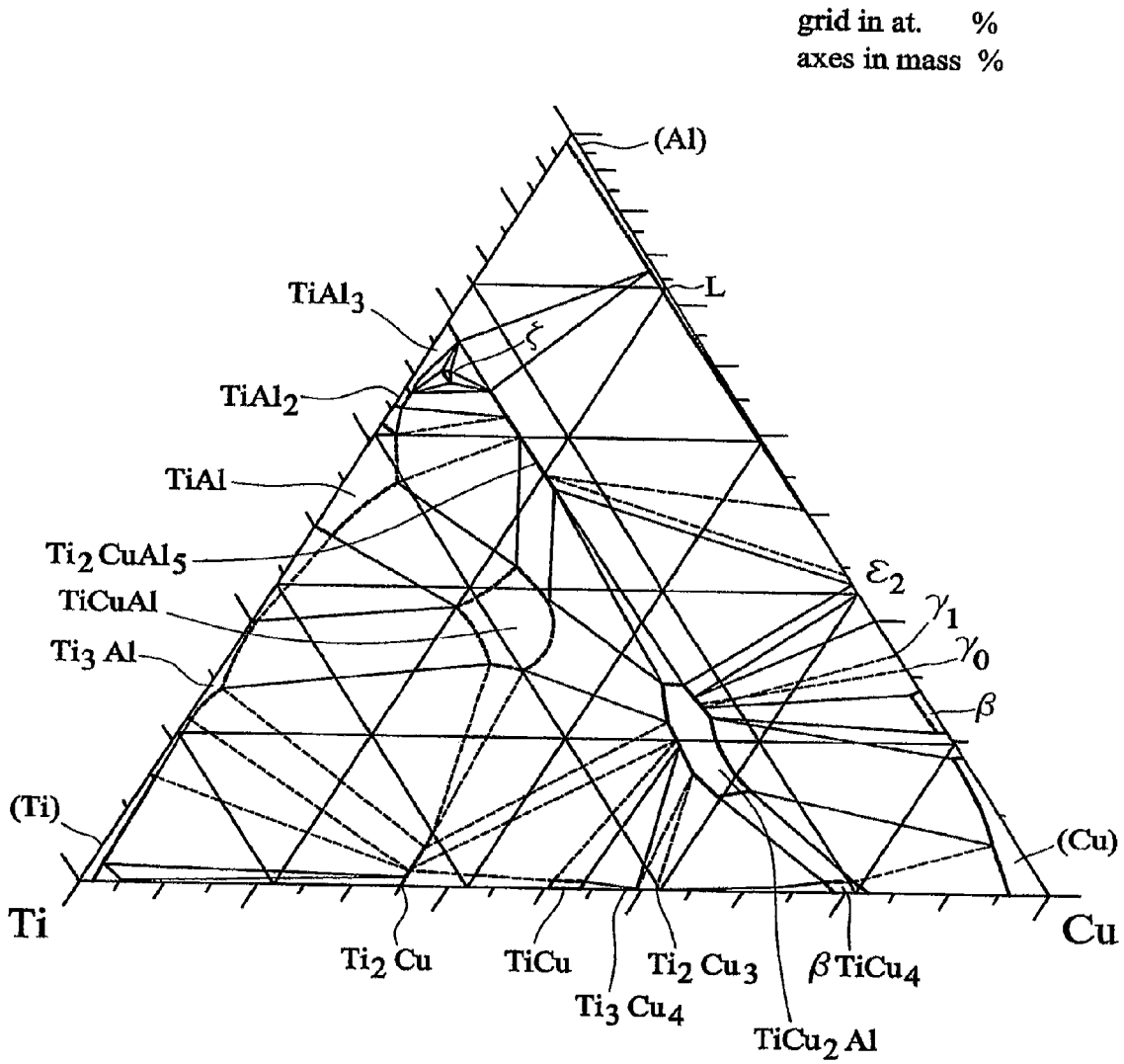
Figure 1C:
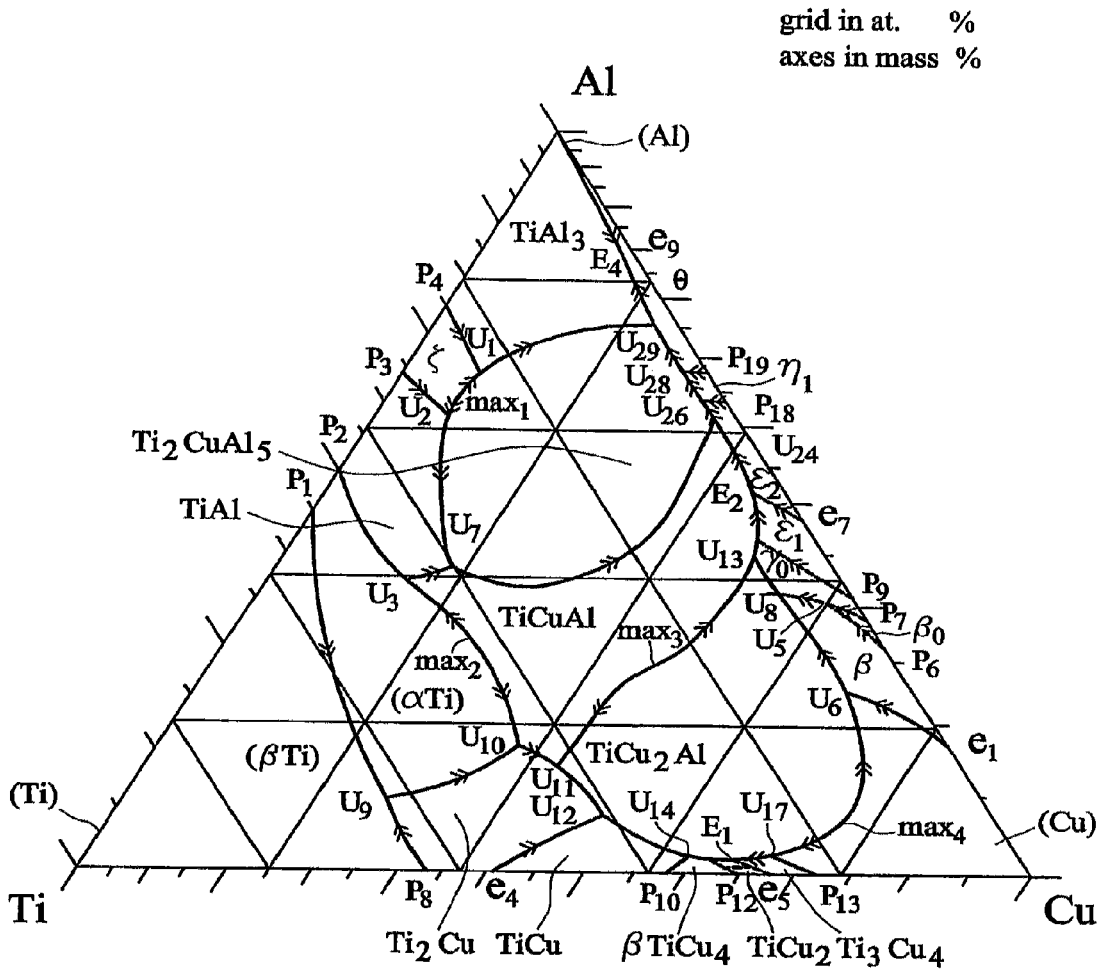
Figure 2A:
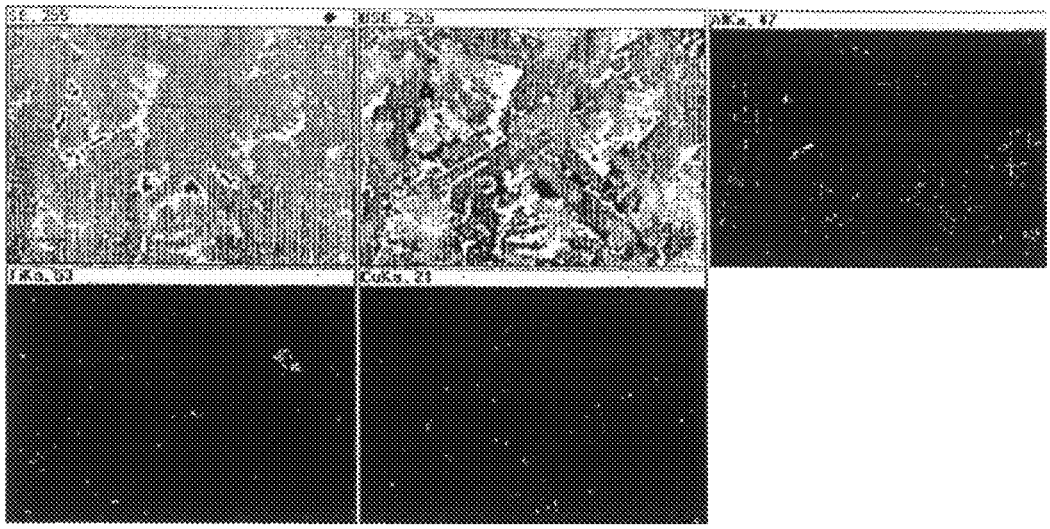
Figure 2B:
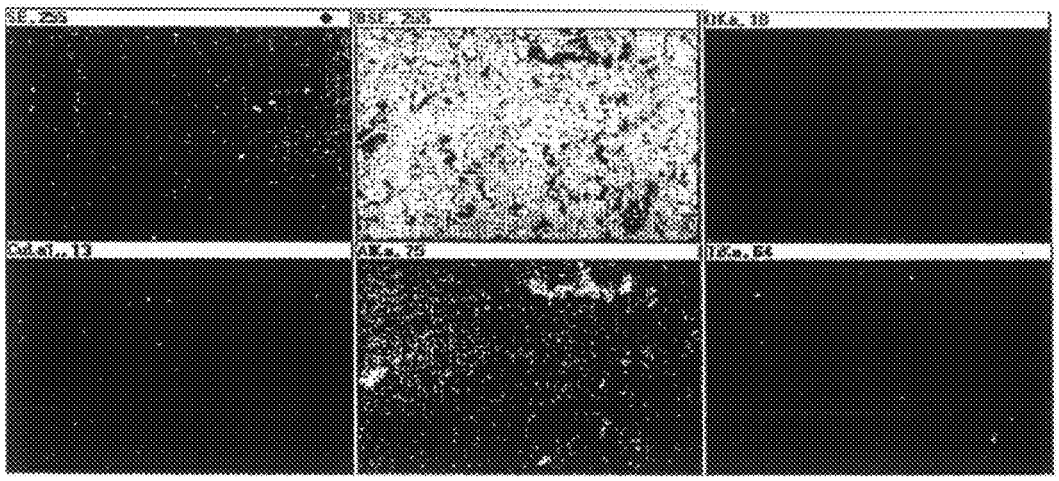
Figure 3A:
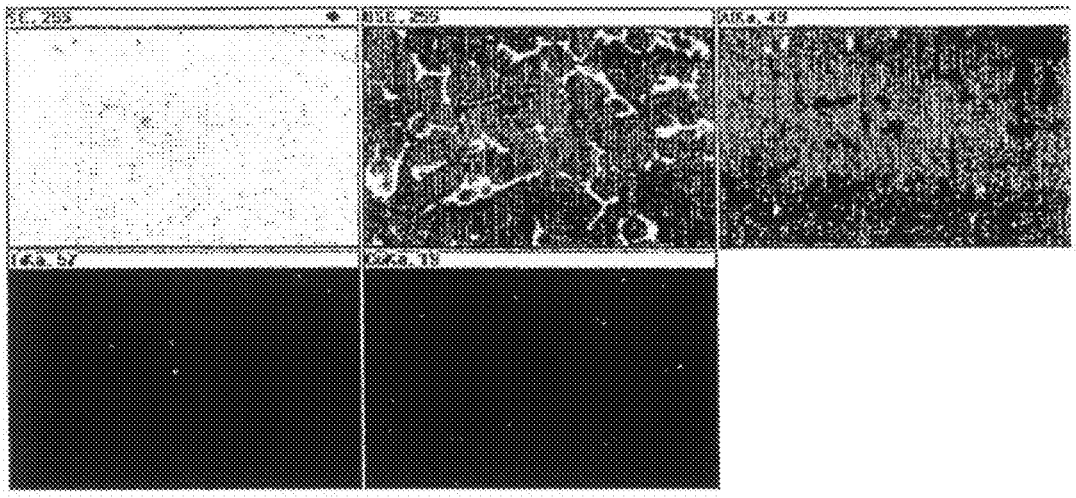
Figure 3B:
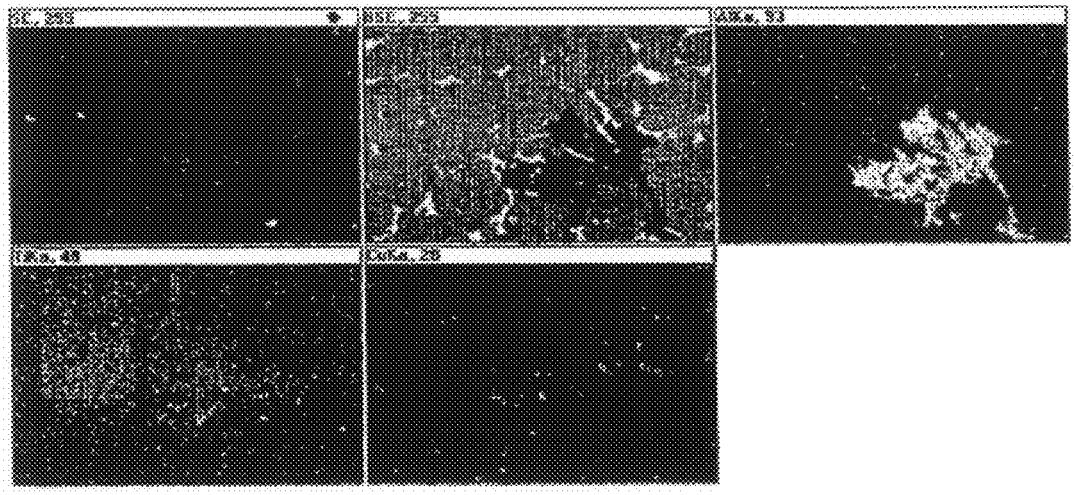

Metallic copper is capable of forming an ordered $CuAl_2$ phase. The phase relationship between $Al_3Ti$, $Al_xTi_yCu_z$ and $CuAl_2$ at 540° C. is shown by way of example in FIG. 1*a* and at 800° C. is shown by way of example in FIG. 1*b* (see *A Handbook of Ternary Aluminium Alloys*—eds G. Petzow, G. Effenberg, Weiheim V C H, vol. 8, Berlin (1988), pp. 51-67).

The amount of titanium metal required for making the ternary intermetallic phase ($Al_5Ti_2Cu$) was calculated and the proportionate amount of potassium fluorotitanate ($K_2TiF_6$) salt was obtained. The salt was reduced in the presence of liquid Al—Cu alloy to effect dissolution of Ti metal. The reduction of the salt with molten aluminium alloy is an exothermic reaction. Consequently the alloy temperature rises to maintain the homogeneity of the alloy phase. The intermetallic phases $Al_3Ti$ and $Al_5Ti_2Cu$ are virtually insoluble in molten aluminium and in the fluoride flux and so offer a unique property for casting alloy almost as a single phase by following the tie line in the Al—Ti—Cu phase diagram. It is evident from the ternary sections shown in FIGS. 1*a* and 1*b* that it is along the ξ, $Al_5Ti_2Cu$, $TiAlCu_2$ and β-$TiCu_4$ phase tie line that the structurally stable compositions fall.

From the phase diagram shown in FIG. 1*e*, the dominant phase transformation reactions, which occur after casting are:

$$\xi \Leftrightarrow TiAl_3+CuTi_2Al_5 \quad 2a$$

and $$\text{Liquid (L)}=\xi+CuTi_2Al_5 \quad 2b$$

Only a small proportion of 2c takes place $$L+CuTi_2Al_5=\theta+TiAl_3 \quad 2c$$

As the volume fraction of phase θ ($CuAl_2$) increases, the rate of liquid phase available above 570° C. increases leading to poor thermal stability of the alloy phase.

EXAMPLE 2

Bearing in mind the existence of low-temperature liquid phases on the copper rich side of the Al-M-Cu phase diagram, compositions were investigated in which the structural and environmental stabilities of the alloy phase were optimised against the electronic conductivity. The reduction in the electronic resistivity as a function of temperature was established to demonstrate the usefulness of the ordered high-temperature alloys as inert electrodes. Three different types of alloy composition were prepared.

Compositions

A first example of a composition (Alloy-1) according to the formula (65+x) atomic % Al, (20+y) atomic % Ti, and (15−x−y) atomic % Cu was fixed along the isoplethal lines of Al:Ti ratio of 2-3 (preferably 2.7) with substitution of aluminium by copper.

A second example of a composition (Alloy-2) falls along the tie line joining $Al_3Ti$ with the $AlTiCu_2$ phase field. This is a high copper phase field for which the electronic conductivity is much higher than Alloy-1.

Further examples of compositions (Alloys-4 to -8) were multi-component derivatives of a third composition (Alloy-3) resulting from partial substitution by phase stabilising elements (Fe, Cr, Ni, V, La, Nb, Zr) to enhance high-temperature stability of the phases. These elements tend to form ordered phases with Al, Ti, and Cu along the tie lines shown in FIG. 1*b*.

TABLE 1

Compositions
ALLOY COMPOSITION (in atomic %)

| | CODE | Al | Ti | Cu | Ni | Zr | Nb | V | Fe | Cr |
|---|---|---|---|---|---|---|---|---|---|---|
| 1 | Standard ternary Alloy-1 | 67.6 | 25 | 7.4 | | | | | | |
| 2 | Standard ternary Alloy-2 | 65 | 24 | 11 | | | | | | |
| 3 | Standard ternary Alloy-3 (=S) | 70 | 25 | 5 | | | | | | |
| 4 | S—Ni | 70 | 25 | 3 | 2 | | | | | |
| 5 | S—NiFeCr | 68 | 23 | 3 | 2 | 0 | 0 | 0 | 2 | 2 |
| 6 | S—NiFeNb | 68 | 23 | 3 | 2 | 0 | 2 | 0 | 2 | 0 |
| 7 | S—NiFeZrVNb | 68 | 19 | 3 | 2 | 2 | 2 | 2 | 2 | 0 |
| 8 | S—NiFeZrVNbCr | 65 | 17 | 3 | 2 | 2 | 2 | 2 | 2 | 2 |

Processing Conditions

The alloy compositions were melted by the following techniques.

a) The metallic elements were weighed and melted in an argon-arc melting furnace above 1500° C. After melting and cooling, the alloy compositions were remelted and homogenised in an argon atmosphere. The homogenised alloy compositions were cooled slowly and prepared for characterisation.

b) In a reactive melting technique, binary Al—Cu alloy was first melted using a potassium fluorotitanate flux. The flux melts above 550° C. and is reactive with molten aluminium above the melting point of Al or the Al—Cu alloy. This melting sequence prevents loss of aluminium in the flux. It is also important for efficient incorporation of Ti in the alloy phase. The reaction between the potassium fluorotitanate salt and molten aluminium is exothermic and the heat generated is sufficient to keep a large volume of alloy above the liquidus temperature when the mass of the alloy exceeds a few kilograms. Excess thermal energy improves alloy homogeneity.

The addition of copper at an early stage of melting proves advantageous for enhancing the solubility of titanium in the alloy phase. The arc-melted and the flux-melted alloy compositions were homogenised at 1350° C. and then allowed to cool inside the copper crucible in the arc melter and alumina crucible in the radio-frequency coil respectively.

The alloy produced after reactive melting with the fluoride salt in air was cast into a small mould. The as-cast material was analysed to determine its properties. Alloys-1 and 2 were thermally cycled using a differential thermal analysis instrument to study the effect of temperature on the likely phase transformation reactions which may potentially cause dimensional changes in the electrode structure. Table 2 presents the hardness of Alloys-1 and 2 in the as-cast and thermally-cycled conditions ($H_v$, load 10 kg) and their as-cast resistivity. The density of Alloy-2 is 4.2 $gcm^{-3}$. The microstructure of the as-cast and heat treated Alloys are shown in FIGS. 2*a*, 2*b*, 3*a* and 3*b*. The corresponding energy dispersive X-ray analysis of the alloy microstructures is summarised in Tables 2a and 2b in terms of an elemental analysis of the matrix phase rich in Al and M elements and the conducting Cu-containing phases.

TABLE 2

| Composition, at % | | | As-cast | Hardness $H_v$, | Hardness $H_v$, $2^{nd}$ | As-cast resistivity |
|---|---|---|---|---|---|---|
| Al | Ti | Cu | hardness $H_v$ | $1^{st}$ cycle | cycle | μohm cm |
| 67.6 | 25 | 7.4 | 220-250 | 143-145 | 170-176 | 5 |
| 65 | 24 | 11 | 251-253 | 224-228 | | 3.4 |

TABLE 2a

| Processing | Composition (atomic %) | | |
|---|---|---|---|
| condition | Al | Ti | Cu |
| As-cast Alloy-1 | 66.4 | 27.0 | 6.6 |
| " | 67.9 | 16.1 | 16.0 |
| " | 62.0 | 10.0 | 28.0 |
| " | 74.5 | 10.1 | 15.5 |

TABLE 2a-continued

| Processing | Composition (atomic %) | | |
|---|---|---|---|
| condition | Al | Ti | Cu |
| After thermal cycle, Alloy-1 | 65.4 | 26.3 | 8.3 |
| After thermal cycle, Alloy-1 | 74.0 | 25.6 | 0.4 |
| After thermal cycle, Alloy-1 | 5.4 | 93.7 | 0.9 |

TABLE 2b

| Processing | Composition (atomic %) | | |
|---|---|---|---|
| condition | Al | Ti | Cu |
| As-cast Alloy-2 | 63.9 | 25.4 | 10.7 |
| " | 62.2 | 27.3 | 10.5 |
| " | 65.2 | 1.8 | 33.0 |
| " | 22.6 | 74.3 | 3.1 |
| After thermal cycle, Alloy-2 | 62.5 | 26.8 | 10.7 |
| After thermal cycle, Alloy-2 | 66.1 | 1.7 | 32.3 |
| | 73.6 | 26.1 | 0.3 |
| After thermal cycle, Alloy-2 | 49.8 | 0.8 | 49.4 |

Room and high temperature resistivity measurements were carried out using an alloy sample which was 8.8 mm long, 4.8 mm deep and 5.3 mm wide by measuring the voltage drop across the length of the electrode while maintaining 1 A current at a given temperature.

Figure 5A:
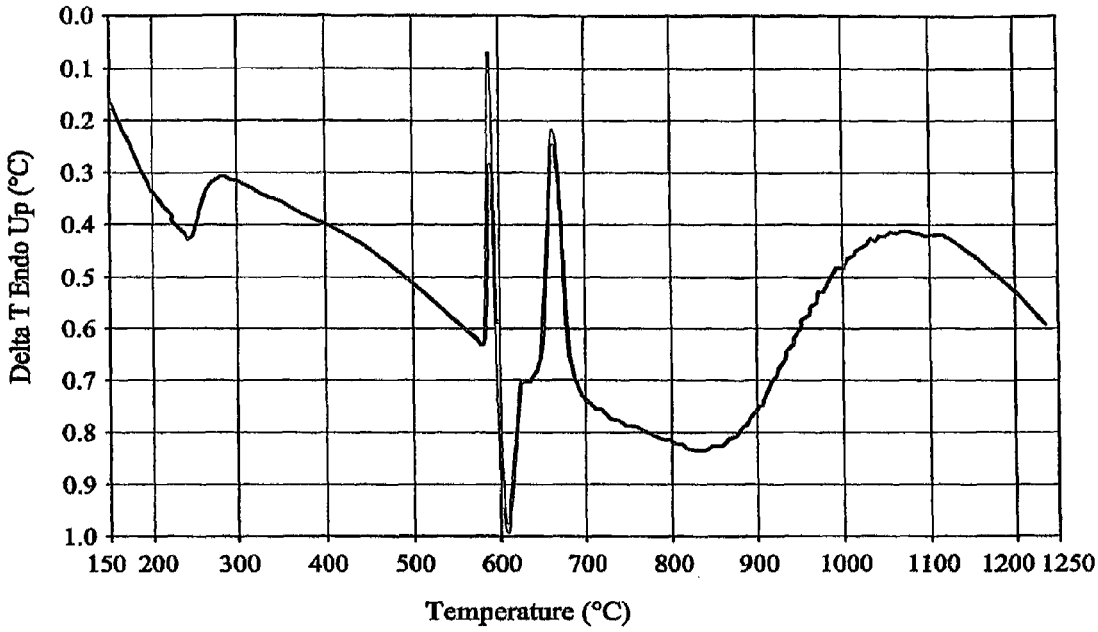
Figure 5A:
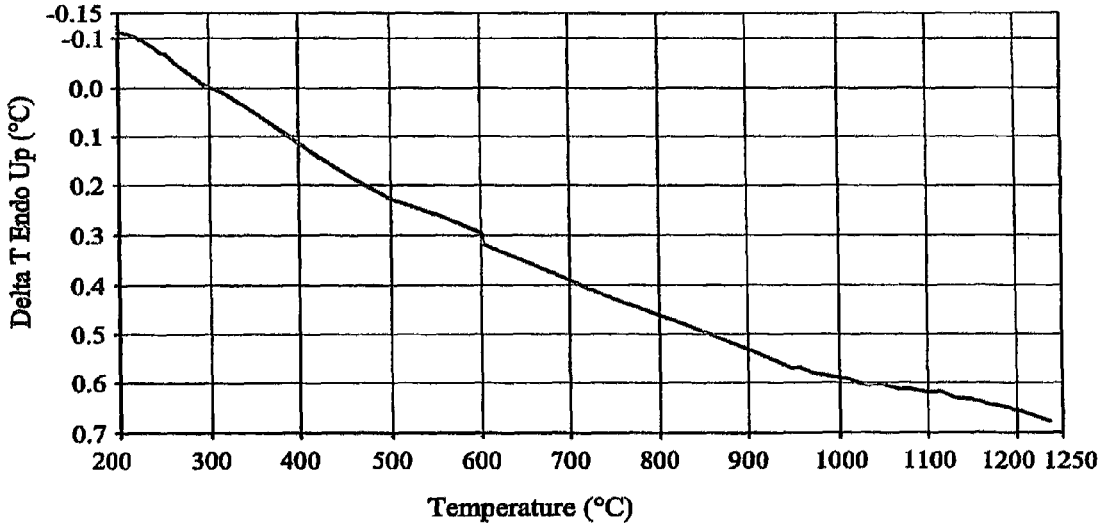
Figure 5B:
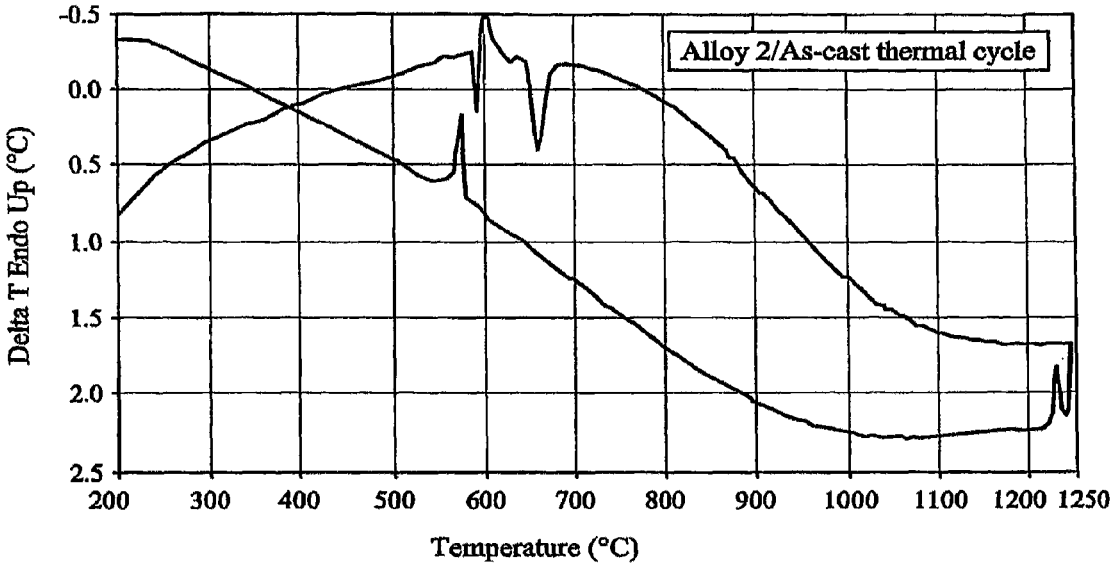
Figure 5B:
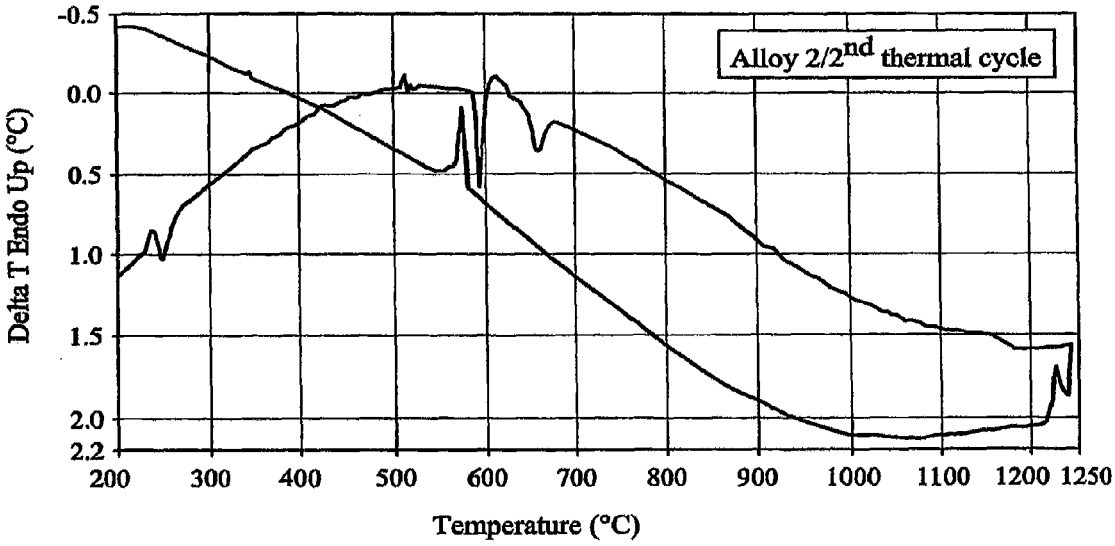

The results of thermal cycling shown in FIGS. 5*a* and 5*b* indicate that the alloy phase does not have a major $1^{st}$ order transformation (volume related phase change) and that only a $2^{nd}$ order transformation with a negligible change in the volume occurs at around 600° C. The presence of liquid phase due to reaction 2*c* (see above) is negligible in the small size structures which may be magnified in the large structures. The presence of minor liquid phase however can be compensated by the addition of excess M elements (see the tie lines in FIG. 1*b*).

Figure 4:
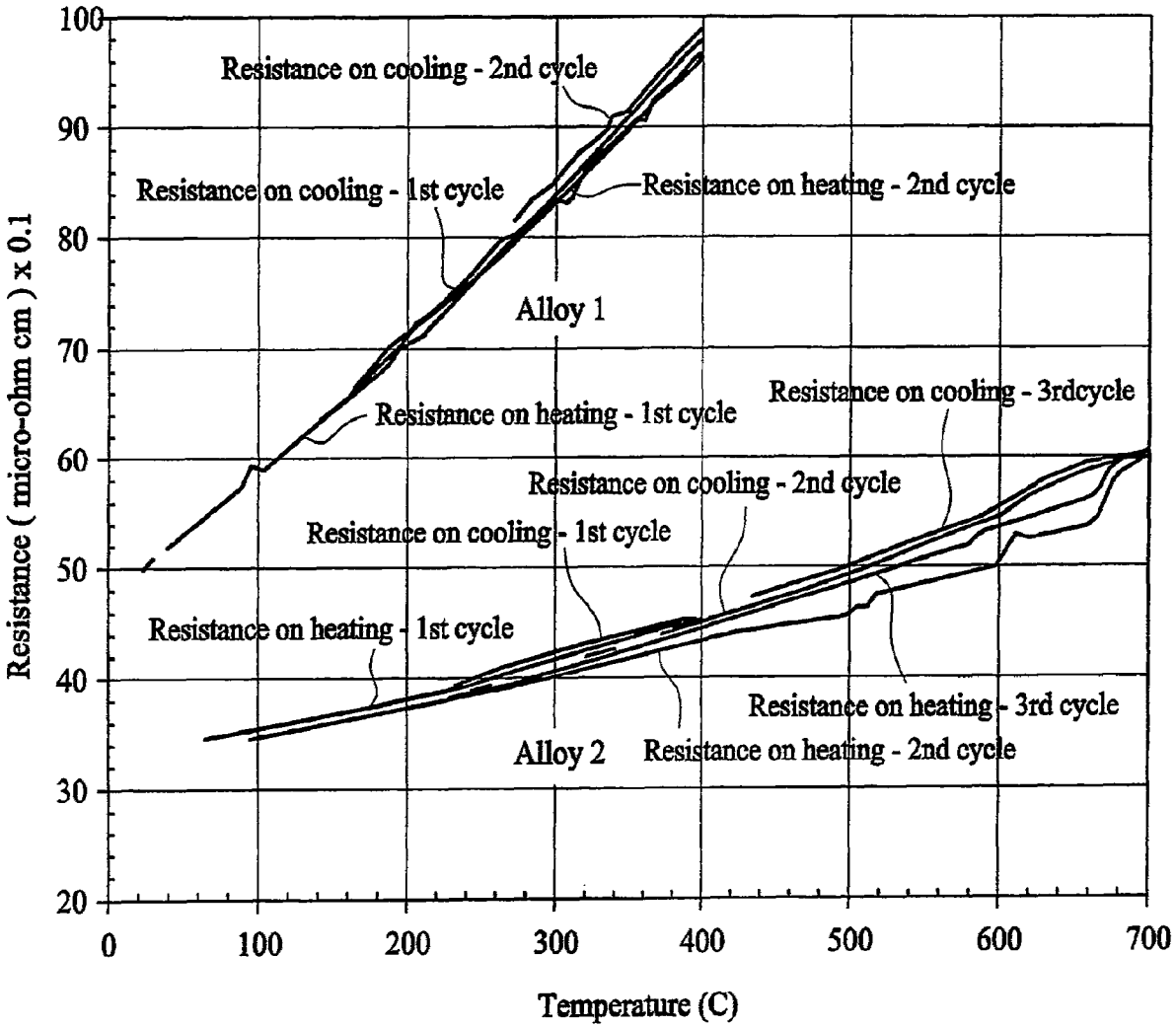

The as-cast resistivity of alloy 1 was 5 μohm cm which dropped to 4 μohm cm after the $1^{st}$ thermal cycling. The effect of thermal cycling on the resistivities of Alloy-1 and 2 are shown in FIG. 4 and the corresponding DTA curves are shown in FIGS. 5*a* and 5*b*.

The resistivity measurements are compared with the resistivities (μohm cm) of pure copper, aluminium, titanium, graphite and a ceramic at 20° C. in Table 3.

TABLE 3

| Material | Cu | Al | Graphite | Ti | $TiB_2$ | New Alloy, Al—M—Cu |
|---|---|---|---|---|---|---|
| Resistivity, μohm cm | 1.68 | 2.65 | 1375 | 42 | 17 | 3.45-5.00 |

| Sample | S | S—Ni | S—NiFeCr | S—NiFeNb | S—NiFeZrVNb | S—NiFeZrVNbCr |
|---|---|---|---|---|---|---|
| Resistivity ($10^{-5} \times \Omega \cdot$ cm) | 2.85 | 3.92 | 8.99 | 10.21 | 12.32 | 15.21 |

The comparison of the resistivities of various metals and graphite with the alloy compositions confirm that there is between 275 and 350 times reduction in the Joule loss ($I^2R$ type) which will compensate for the necessary increase in the value of EMF due to the lack of production of $CO_2$ (as in conventional techniques).

Electrode Wettability and Corrosion Tests i) 4 cm long alloy ingots were suspended in a bath of molten sodium-containing (10% by weight) potassium cryolite ($3KF.AlF_3$) in contact with liquid aluminium at 775° C. The length of ingot submerged in the flux bath was approximately 1 cm. It was allowed to stay in contact with molten flux for a maximum period of 1 hour at 775° C. after which the ingot sample was withdrawn and examined for evidence for any high-temperature chemical attack. The ingot was wetted by cryolite flux and no chemical reaction between the ingot and the flux or metal or any discernible weight change was observed.

ii) A high-temperature oxidation experiment was carried out by heating a 1 $cm^3$ lump of alloy above 750° C. in air for 2 hours. The alloy surface was slightly tarnished by developing a yellowish metal-like tinge which was also observed on the surface of Ti metals and its alloys. No weight change was observed.

iii) The presence of a small concentration of $KBF_4$ (less than 5 wt %) improved dramatically the wettability of alloy with $K_3AlF_6$—$Na_3AlF_6$ flux. It was observed that when the alloy was withdrawn from the B-containing flux, the alloy surface was clean and shiny compared with when no boron was present in the flux.

Aluminium Extraction Test

Figure 6A:
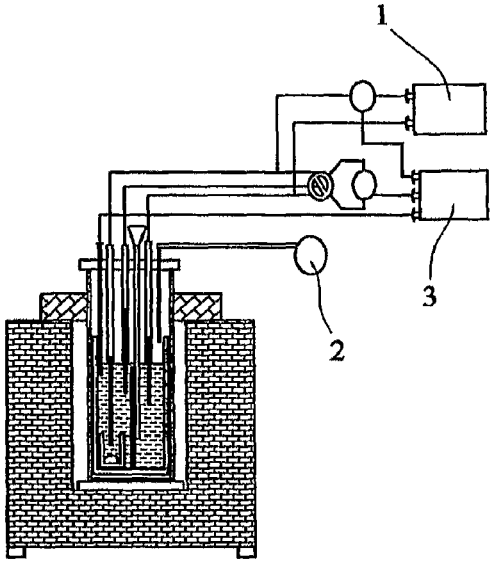
Figure 6B:
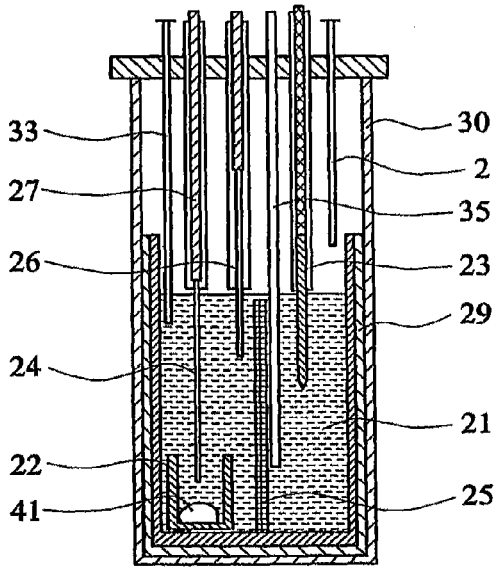

Using 100 ml of cryolite (21) saturated with alumina, cell tests for extracting aluminium metal (41) were carried out (see FIGS. 6*a* and 6*b*). The cell was an alumina crucible (22) comprising a cathode (24) with an alumina sheath (27), reference electrode (26) and anode (23) separated by an alumina partition (25). The alumina crucible (22) was situated in a carbon crucible (29) inside a stainless steel container (30). The cell further comprises a thermocouple (33) and an argon gas supply (2).

Electrolysis experiments included the use of alloy anode and carbon cathode, carbon anode and carbon cathode, carbon anode and alloy cathode and alloy anode and $TiB_2$ cathode to study reactions with cryolite. The electrolyte (21) consisted of 36 wt % NaF and 64 wt % $AlF_3$. The bath was saturated with alumina using alumina spheres. The alumina and salt were charged through a port (35).

Figure 7:
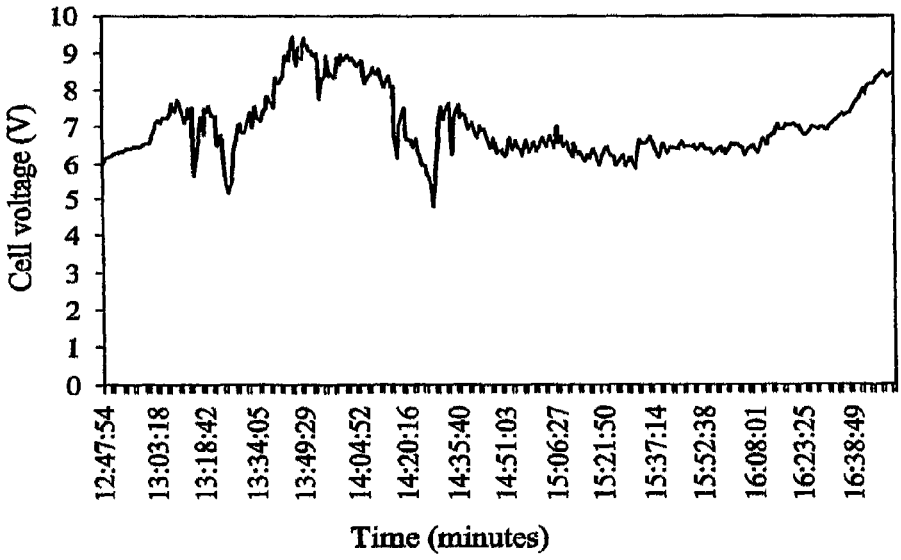
FIG. 7 is a plot of time verses cell voltage for the electrolysis of a S—NiFeCr alloy anode at 850° C. for 4 hours.

The electrolysis experiment was carried out for 4-6 hours at different temperatures. A constant DC current of 4-6 A from a DC power supply (1) was passed through the cell and the cell voltage and temperature were measured using a data logger (3). The cell results are shown in Table 4. A typical plot of time against cell voltage and temperature is presented in FIG. 7.

For each cell test, it was found that cell voltage increased at the beginning due to the anode effect and then stabilised for a while and finally increased again. The small variations in the cell voltage are due to the various reactions of the anode surface with cryolite. Any voltage drop relates to corrosion reactions since the minimum voltage required for aluminium production using carbon anode is 4.5 V. For alloy anode, it is expected to be more due to the absence of $CO_2$ generation. However by comparison the alloy has much lower electrical resistivity compared with carbon (approximately 20 times) but 10 times higher than that of copper.

Figure 8:
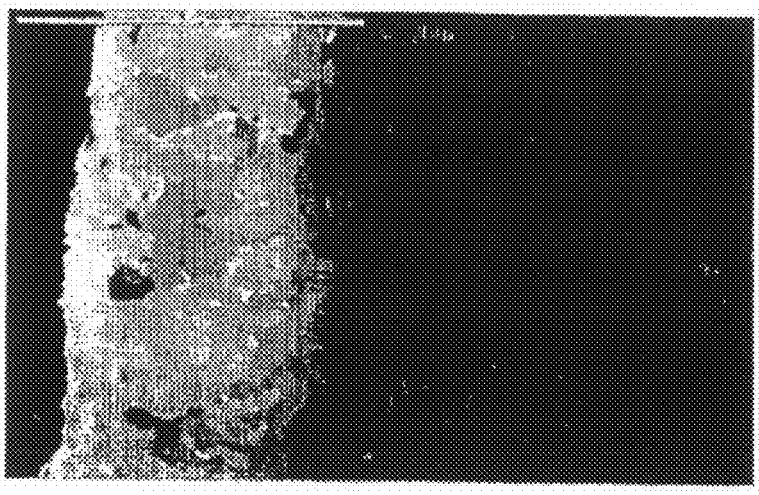
FIG. 8 illustrates the microstructure of the S—NiFeCr alloy anode after an electrolysis experiment in an alloy anode/carbon cathode test cell.

The voltage rose in the final stage due to the loss of electrolyte via evaporation which then supersaturates the cryolite with respect to alumina. Since the cell current is fixed, any rise in voltage is a manifestation of increased bath resistance. The most important finding is that of the control of saturation of alumina in the bath. The presence of a passivating layer and saturation of alumina in the bath are key to good corrosion resistance of the anode in the bath. FIG. 8 shows the presence of a passivating layer on the peripheral surface of the anode (the bright phase). This anode shows very good corrosion resistance.

TABLE 4

| Parameters | Run No 1 | Run No 2 | Run No 3 | Run No 4 | Run No 5 | C anode and Alloy cathode | Alloy anode and C cathode |
|---|---|---|---|---|---|---|---|
| Constant current (A) | 4 | 4 | 6 | 6 | 4 | 4 | 4 |
| Average voltage (v) | 7 | 9 | 9 | 9 | 5.5 | 6.5 | 7 |
| Bath volume (g) | 160 | 160 | 160 | 160 | 180 | 160 | 160 |
| Bath temperature (° C.) | 850 | 900 | 850 | 850 | 850 | 850 | 850 |
| Operating time (hour) | 4.5 | 4 | 3 | 4.5 | 4.5 | 4 | 4 |
| Added $Al_2O_3$ (g) | 11.4 | 11.4 | 11 | 12 | 12 | 11.4 | 11.4 |
| Produced metal Al (g) | 4.4 | 4.7 | 3.8 | 5.1 | 2.5 | 4.2 | 4.9 |
| Power consumption per gram of Al produced (watt) | 29 | 31 | 43 | 48 | 40 | 25 | 23 |

EXAMPLE 3

Compositions and their Microstructures Before and After Corrosion Tests

Figure 9:
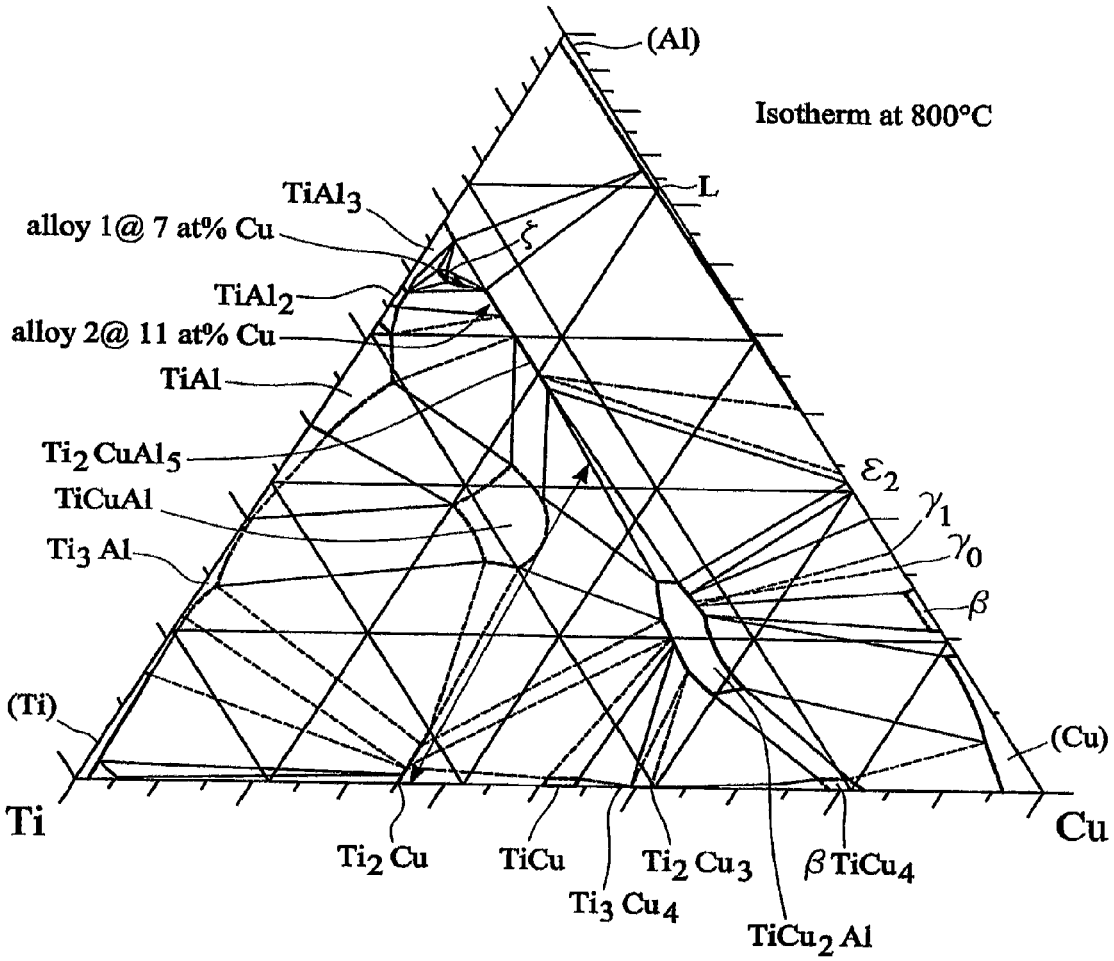
FIG. 9 is a phase diagram of the Al—Ti—(Cu, Fe, Ni, Cr) pseudo ternary section at 800° C.
Figure 11B:
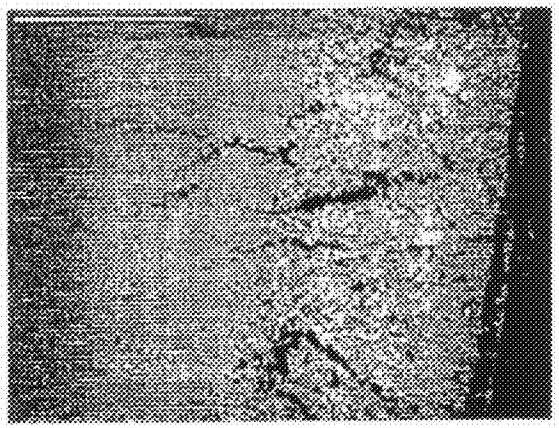
Figure 11D:
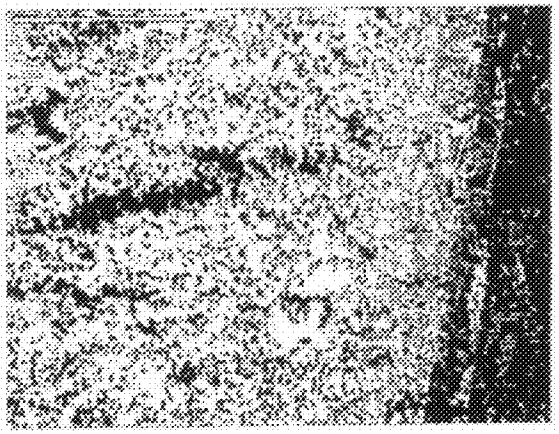
Figure 11A:
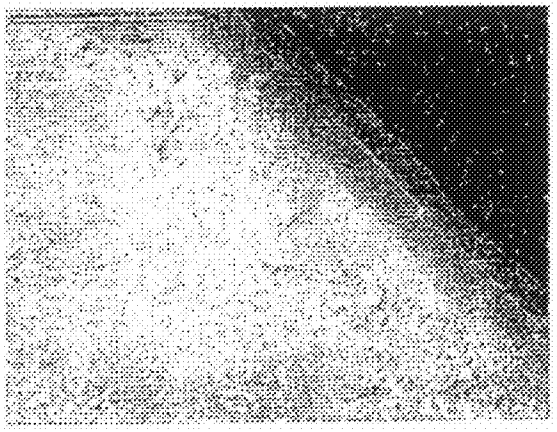
Figure 11C:
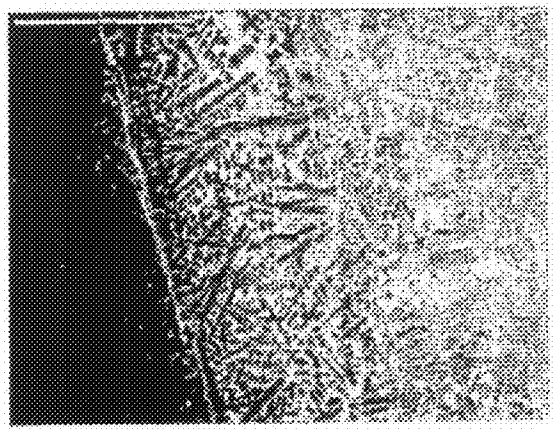

Table 5 shows a typical example of a new composition of an AlTiCu alloy with the transition metals Ni, Fe and Cr (new S—NiFeCr) compared with composition S—NiFeCr of Example 2 (alloy code 5). The new composition falls in the left hand part of the ternary phase diagram illustrated in FIG. 9 with an arrow. In this composition range, an equi-atomic ratio of Al:Ti (eg 35:35) can be mixed with a minor metal M=Cu, Fe, Cr or Ni which may vary between 3 at % to 30 at %. The alloy was melted in an argon atmosphere above 1500° C. and was cast as before for the composition S—NiFeCr of Example 2. The development of the new composition arises from the analysis of the passivation layer in the S—FeNiCr alloy system of Example 2.

| | Alloy Code | |
|---|---|---|
| Composition (atomic %) | New S—NiFeCr | S—NiFeCr (code 5) |
| Al | 51 | 68 |
| Ti | 40 | 23 |
| Cu | 3 | 3 |
| Ni | 2 | 2 |
| Fe | 2 | 2 |
| Cr | 2 | 2 |

Figure 10B:
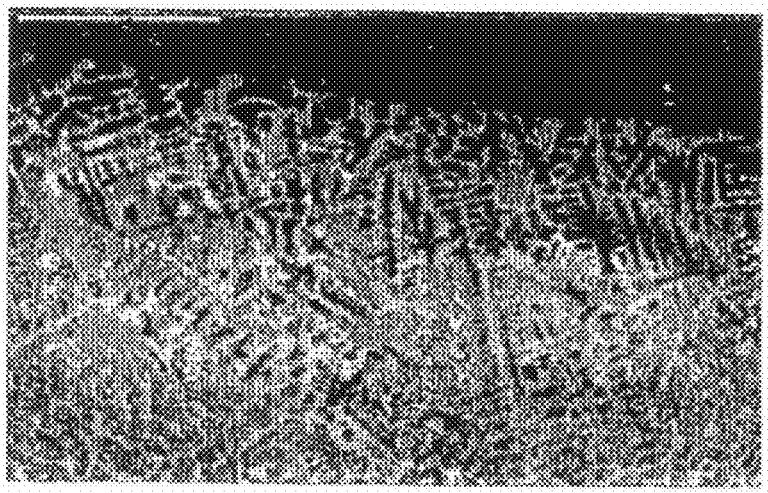

FIGS. 10-12 compare the corrosion behaviour of two alloys in a different salt bath under identical temperature and atmospheric conditions. In particular, FIGS. 11*a* and *c* illustrate corrosion behaviour of the new S—NiFeCr composition compared with that of the S—NiFeCr composition of Example 2 (alloy code 5) in FIGS. 11*b* and *d*. The new composition is shown to be more resistant to corrosion than the compositions discussed in Example 2 which had 60-70 a % Al, 20-25 at % Ti, 3-5 at % Cu and the balance Fe, Cr, and Ni. The improved corrosion performance in the $CaCl_2$ bath also used in the molten salt electro-winning of metals has been compared and verified. The small crevices in the microstructure are due to the presence of HCl induced corrosion which is always prevalent when calcium chloride is heated above its melting point. This can be removed by proper vacuum drying technique.

The invention claimed is:

1. A process for preparing an Al-M-Cu based alloy comprising adding an alkali fluorometallate flux to a source of Cu and a source of Al to form an intermetallic phase of the formula:

$$Al_xM_yCu_z$$

wherein:

M denotes one or more metallic elements;

x is an integer in the range 1 to 5;

y is an integer being 1 or 2; and z is an integer being 1 or 2.

2. A process as claimed in claim 1 wherein the alkali fluorometallate flux is formed from a potassium or sodium alkali fluorometallate salt.

3. A method for extracting a reactive metal from a reactive metal-containing source comprising: electrolytically contacting an electrode composed of an Al-M-Cu based alloy with the reactive metal-containing source.

4. A method as claimed in claim 3 wherein the reactive metal is Al.

5. A method as claimed in claim 3 wherein the reactive metal-containing source is an alumina-saturated cryolite flux.

6. A method as claimed in claim 5 wherein the cryolite flux comprises sodium-containing potassium cryolite.

7. A method as claimed in claim 5 wherein $KBF_4$ is present in the cryolite flux.

* * * * *